United States Patent [19]

Stastny

[11] 4,403,864

[45] Sep. 13, 1983

[54] SUPPORT DEVICE FOR MIXER AUGER

[75] Inventor: Joseph F. Stastny, Indianola, Iowa

[73] Assignee: Cemen, Tech, Inc., Indianola, Iowa

[21] Appl. No.: 369,149

[22] Filed: Apr. 16, 1982

[51] Int. Cl.[3] ..... B28C 7/06

[52] U.S. Cl. ..... 366/19; 308/230; 366/50; 366/64; 366/182; 366/318

[58] Field of Search ..... 366/16–21, 366/26, 30, 33, 37, 36, 38, 49, 50, 68, 64–67, 76, 154, 96–98, 133, 134, 141, 155, 160, 162, 177, 182, 181, 187, 186, 208, 213, 214, 215, 219, 220, 237, 318, 261, 349, 606; 308/230

[56] References Cited

U.S. PATENT DOCUMENTS

| | | | |
|---|---|---|---|
| 778,379 | 12/1904 | Slentz | 308/230 |
| 931,657 | 8/1909 | Scott et al. | 366/19 |
| 1,378,965 | 5/1921 | Lube | 308/230 |
| 2,976,025 | 3/1961 | Pro | 366/20 |
| 3,625,488 | 12/1971 | Farnham et al. | 366/18 |
| 4,022,439 | 5/1977 | Groth | 366/50 X |
| 4,089,509 | 5/1978 | Morton et al. | 366/17 X |
| 4,117,547 | 9/1978 | Mathis et al. | 366/50 X |
| 4,245,915 | 1/1981 | Bracegirdle | 366/17 X |

*Primary Examiner*—Philip R. Coe
*Assistant Examiner*—Timothy F. Simone
*Attorney, Agent, or Firm*—Zarley, McKee, Thomte, Voorhees & Sease

[57] ABSTRACT

The support device of the present invention comprises a stationary outer collar and a rotatable inner collar concentrically located within the outer collar. An outwardly extending flange is attached to the outer surface of the inner collar and an inwardly extending flange is attached to the inner surface of the outer collar. These two flanges are superimposed over one another and a plurality of ball bearings are interposed between them so as to permit the inner collar to rotate with respect to the outer collar. The mixer auger is attached to the inner collar and consequently the auger can be rotated about the rotational connection between the inner and outer collars.

5 Claims, 14 Drawing Figures

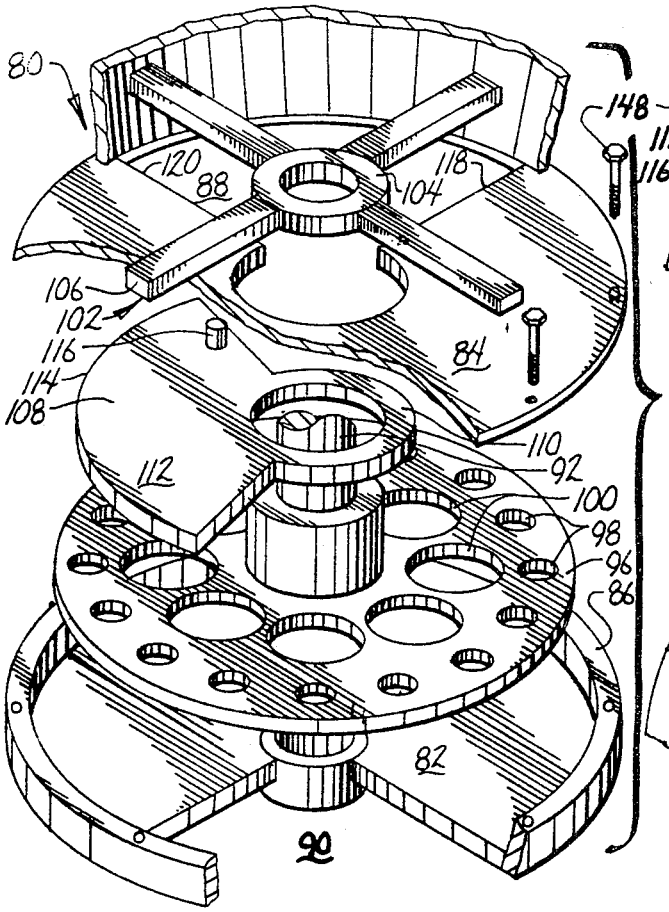
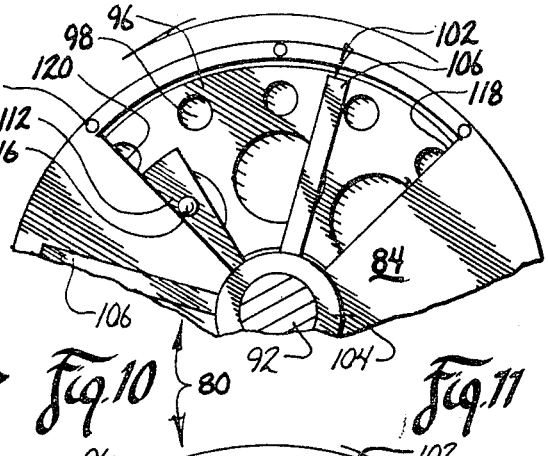
Fig. 10
Fig. 11
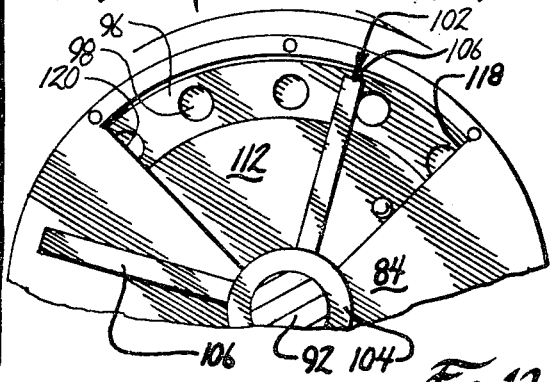
Fig. 12
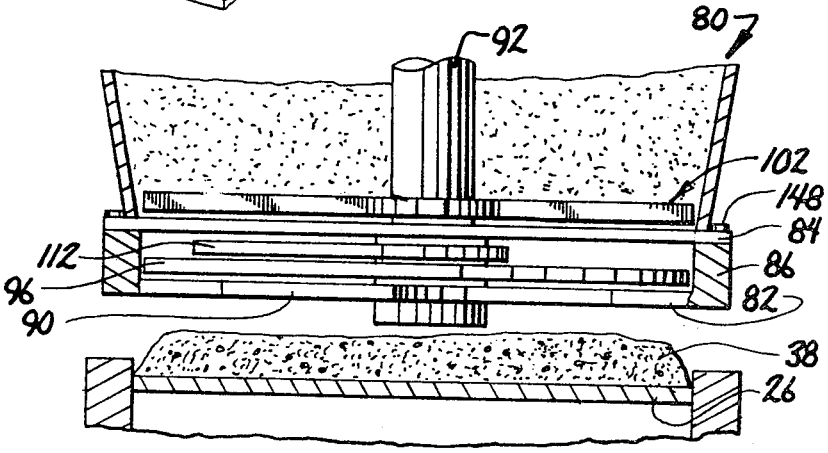
Fig. 13
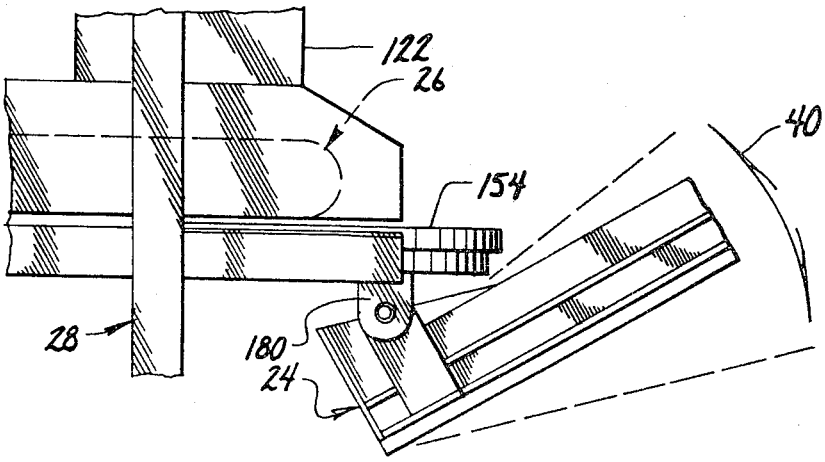
Fig. 14

SUPPORT DEVICE FOR MIXER AUGER

BACKGROUND OF THE INVENTION

This invention relates to a device for metering pulverulent ingredients utilized in a concrete mixture. This invention also relates to a device for mounting and supporting an auger mixer.

The metering of ingredients for concrete have heretofore been done by metering the weight rather than the volume of the ingredients. Metering by weight eliminates the possibility that the concrete can be mixed in a continuous process. Instead, the ingredients must be weighed separately and then mixed together in batches.

Another problem encountered with present metering devices is that they are difficult to adjust to provide for different formulations for the concrete mixer. Materials such as pigment, cement and aggregate are often mixed in different combinations and proportions to achieve the desired result.

Therefore, a primary object of the present invention is the provision of an improved metering device for metering the ingredients for a concrete mixer.

A further object of the present invention is the provision of a metering device which permits the ingredients to be metered by volume rather than by weight.

A further object of the present invention is the provision of a metering device which permits continuous mixing rather than batch mixing as has been the case in previous devices.

A further object of the present invention is the provision of a metering device which is flexible in permitting the adjustment of the amounts of the various ingredients added to the concrete mixer.

A further object of the present invention is the provision of a device which withstands wear from the pulverulent materials during the metering process.

A further object of the present invention is the provision of a device which continuously adds and meters aggregate, pigment, and cement prior to the time that the mixture is mixed.

A further object of the present invention is the provision of an improved support assembly for supporting the auger mixer so that it can be rotated and moved with ease.

A further object of the present invention is the provision of a device which is economical to manufacture, durable in use, and efficient in operation.

SUMMARY OF THE INVENTION

The present invention utilizes a conveyor belt which progresses below various stations adapted to deposit the ingredients for the concrete mixture on the conveyor belt. The first station includes an aggregate hopper which deposits a predetermined volume of aggregate on the conveyor as it passes through an adjustable gate at the bottom of the aggregate hopper. Next, the belt passes beneath a plurality of pigment hoppers, each of which deposit a predetermined volume of pigment on the aggregate as it passes therebeneath. Finally, the conveyor passes beneath the cement hopper which deposits a predetermined volume of cement on the pigment and aggregate. The conveyor then deposits the mixture of pigment, aggregate and cement in an auger mixer which mixes the ingredients so that the cement can be fully mixed.

The present invention utilizes a continuous feed metering device which permits metering by volume rather than by weight. The device is a cylindrical housing having a feed opening at the upper end and an outlet opening at the lower end. The feed opening and the outlet opening are circumferentially spaced with respect to one another so that material dropping through the feed opening will not fall through the outlet opening. Within the housing below the feed opening is a rotating metering wheel having a plurality of pockets positioned radially outwardly from the center thereof and spaced circumferentially around the circumference thereof. Rotation of the metering wheel causes the material which has dropped through the feed opening to be carried circumferentially within the housing until it is positioned directly over the outlet opening. At that point, the material drops through the outlet opening and out of the metering device.

The amount of material metered by the metering device can be adjusted by adjusting the rotational speed of the metering wheel. The faster the wheel rotates, the greater the amount of ingredient dispatched within a given period of time. By passing a conveyor belt under the metering device, it is possible to increase or decrease the amount of ingredients deposited on the conveyor belt in a given period of time by merely increasing or decreasing the rotational speed of the metering wheel.

One version of the metering device comprises a metering wheel having a plurality of vanes extending radially outwardly from the center thereof. The vanes divide the chamber into a plurality of pie shaped compartments which catch the pulverulent material as it enters the housing and which carry the pulverulent material toward the outlet opening.

A second version of the metering wheel comprises a flat disc having a first circular array of openings extending vertically therethrough and also having a second circular array of openings positioned radially inwardly from the first set of openings. An adjustable cover plate can be positioned over the inner circular array of openings so as to preclude pulverulent material from being carried by these openings. The positioning of the cover plate is accomplished by reversing rotation of the disc so as to cause the plate to rotate therewith and move into a position covering the inner row of holes. This provides a further means for adjusting the volume of material dispatched by the metering device.

The vane type of metering wheel is utilized for ingredients which are metered in rather large volumes such as cement, whereas the disc type metering wheel is utilized for ingredients which are metered in much smaller quantities such as would be the case with pigments added to the concrete.

Another feature of the invention comprises the use of an improved support assembly for supporting the mixing auger at the end of the conveyor. The support assembly includes an inner collar and an outer collar which are rotatable with respect to one another. Ball bearings are positioned between the inner and outer collars so as to permit the auger to be rotated about a vertical axis with respect to the conveyor.

BRIEF DESCRIPTION OF THE DRAWINGS

FIG. 10 is an exploded perspective view of a second modified form of the metering device of the present invention.

FIGS. 11 and 12 are partial top plan views of the device shown in FIG. 10.

FIG. 13 is a front elevational view of the device shown in FIGS. 10–12 with certain portions broken away.

FIG. 14 is an enlarged partial side elevational view of the mixing auger support assembly shown in FIG. 1.

DETAILED DESCRIPTION OF THE INVENTION

Figure 1:
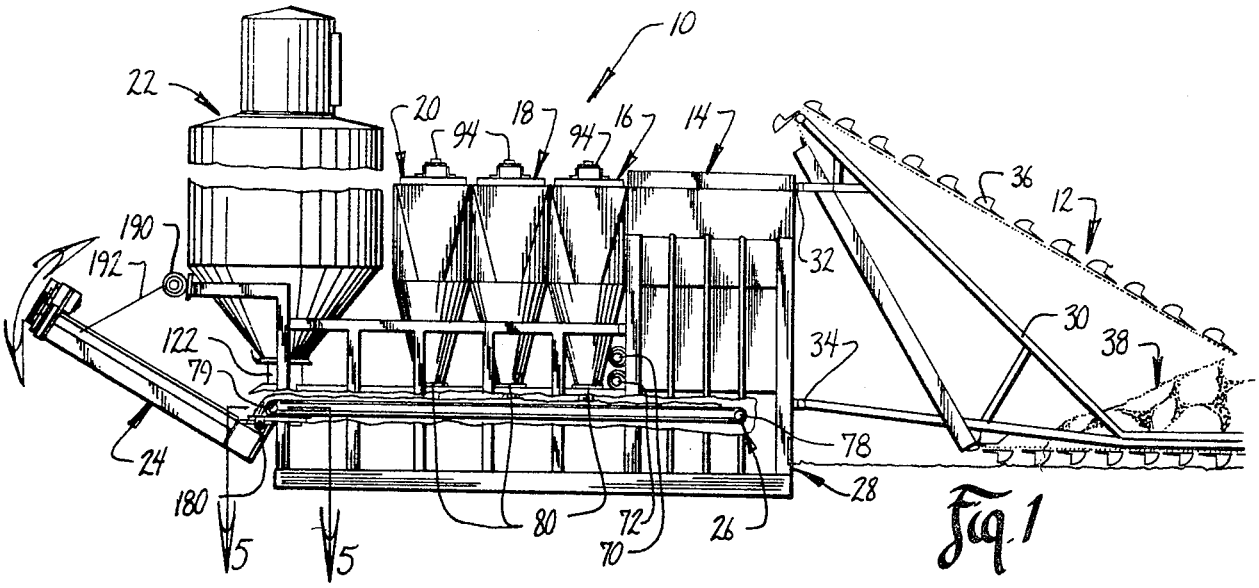
FIG. 1 is a front elevational view of the entire assembly line for metering and mixing concrete.

Referring to the drawings, the numeral 10 generally refers to the concrete mixing and metering system of the present invention. System 10 comprises an aggregate collection conveyor assembly 12, an aggregate hopper assembly 14, three pigment hopper assemblies 16, 18, 20, a cement hopper assembly 22, a concrete mixer auger 24, and a conveyor belt assembly 26. All of these assemblies are supported by a support frame 28.

Figure 2:
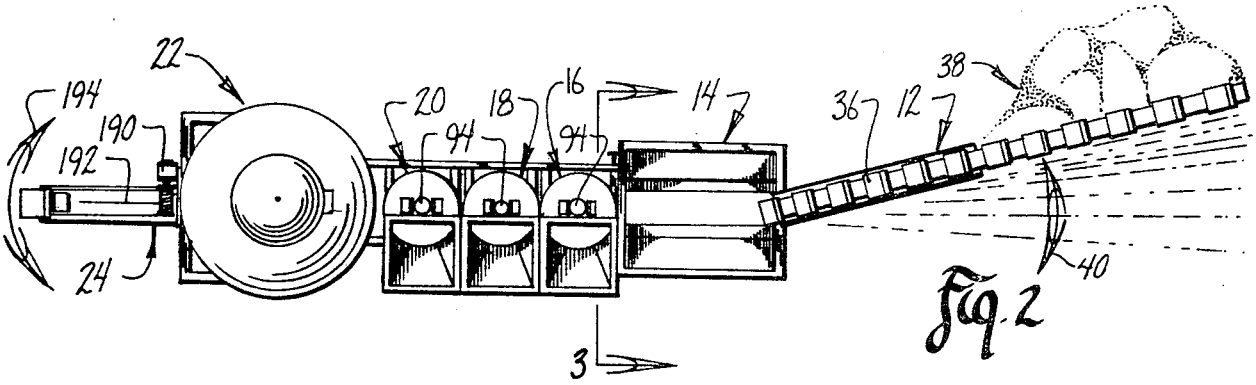
FIG. 2 is a top plan view of the device shown in FIG. 1.

Aggregate conveyor assembly 12 includes a truss boom assembly 30 which is pivotally mounted to support frame 26 for pivotal movement about a vertical axis by means of hinges or couplings 32, 34. Aggregate conveyor assembly 12 includes a plurality of conveyor buckets 36 which are operated in conventional fashion and which travel along the ground to pick up aggregate 38 and deposit the aggregate into the upper end of hopper assembly 14. Power means (not shown) are used to operate conveyor buckets 36 and also are used to rotate the conveyor assembly 12 about hinges 32, 34 in the direction of the arrow 40 (FIG. 2). This permits the conveyor assembly to work into the pile of aggregate 38 to remove it from the ground and carry it upwardly into the upper end of aggregate hopper assembly 14.

Figure 3:
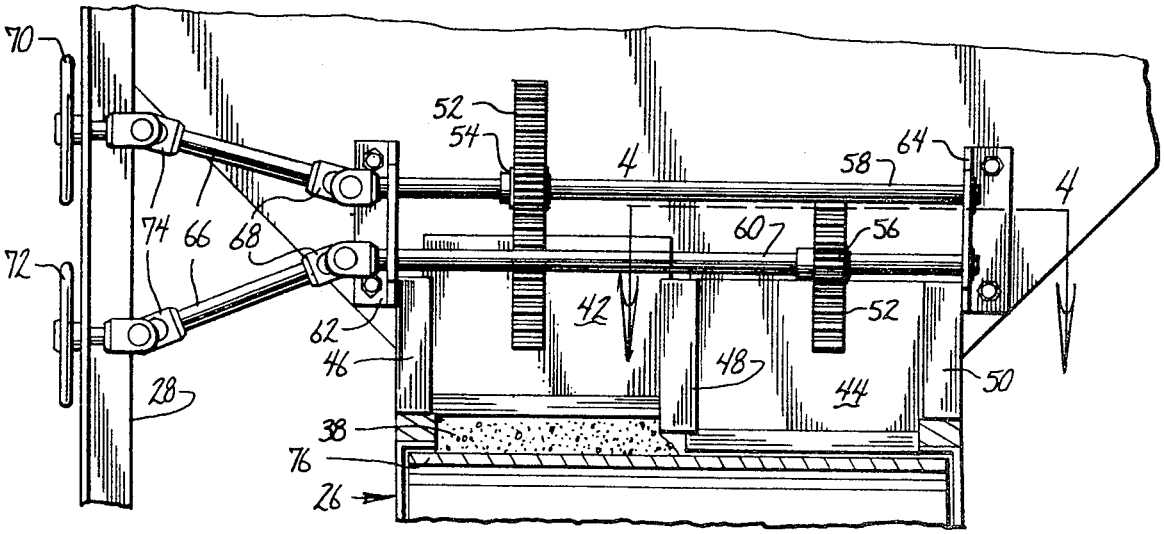
FIG. 3 is an enlarged sectional view taken along line 3—3 of FIG. 2.

Aggregate hopper 14 includes a weir gate provided by two vertical sliding doors 42, 44 (FIG. 3). These doors slide vertically in tracks provided by angle members 46, 48, 50. Means for adjusting the vertical position of doors 42, 44 are provided by elongated rack gears 52 on the outer surface of weir doors 42, 44. Intermeshed with gears 52 are pinion gears 54, 56 which are fixed to horizontal shafts 58, 60, respectively. Shafts 58, 60 are rotatably journaled in angle 62, 64 for rotation about a horizontal axis. A pair of links 66 are connected to the ends of shaft 58, 60 by means of universal joints 68. The opposite ends of links 66 are connected to control wheels 70, 72 by means of universal joints 74.

Thus, by rotating control wheels 70, 72 it is possible to raise or lower weir doors 42, 44 to the desired position.

As can be seen in FIG. 3, weir door 42 is raised to a position which provides a gate for aggregate 38 to be carried by a conveyor belt 76 which forms a part of conveyor belt assembly 26. The amount of aggregate deposited on belt 26 is determined by the height of weir doors 42, 44. Thus, if it is desired to increase the amount of aggregate in the mixture, the weir doors are raised. If it is desired to reduce the amount of aggregate, the weir doors are lowered.

Conveyor assembly 26 comprises a pair of spaced apart drive rollers 78, 79 around which are trained a conveyor belt 76.

Pigment hopper assemblies 16, 18, 20 are of identical construction. Each includes a metering device 80 at its lower end. Device 80 is shown in FIGS. 10–13 and comprises a cylindrical housing having a circular bottom wall 82, a circular top wall 84, and a cylindrical side wall 86. Top wall 84 includes a 90° feed opening 88 therein, and bottom wall 82 includes a 90° outlet opening 90 therein. Openings 88, 90 are circumferentially displaced from one another so that they are not in registered alignment.

Extending vertically through metering device 80 is a rotor shaft 92 which extends vertically upwardly through each hopper assembly 16, 18, 20 to a rotor motor 94 which causes shaft 92 to rotate within metering device 80.

Fixed to rotor 92 is a metering disc 96. Positioned in spaced relation around the outer peripheral edge of disc 96 is a first circular array 98 of metering holes which extend vertically through disc 96. Concentric with circular array 96 and positioned radially inwardly therefrom are a second circular array 100 of metering openings. The second circular array 100 of openings may include openings which are of a different diameter than the openings of circular array 96. The relative sizes of the openings in the array 100 and array 96 may be varied to achieve the high and low ranges of volumes desired or needed for a particular job.

Rotation of shaft 92 causes rotation of disc 96. Also fixed to shaft 92 above top wall 84 is an agitator member 102 which includes a hub 104 fixed to shaft 92 and one or more radially extending bars 106.

When shaft 92 is rotated, agitator member 102 and disc 96 also rotate. The powdered material above top wall 84 is agitated by bars 106 and is caused to fall through inlet opening 88. It falls into the cavities formed by the openings in circular arrays 98, 100, and is carried circumferentially from directly below inlet opening 88 to directly above outlet opening 90. Gravity causes the pulverulent material within the circular arrays 98, 100 to fall outwardly through opening 90.

To increase the volume of pulverulent material being metered, it is merely necessary to increase the rotational speed of shaft 92 which causes pulverulent material to be carried from opening 88 to opening 90 at a greater speed.

A second means for adjusting the volume of material metered is provided by a cover plate 108. Cover plate 108 includes a ring 110 which surrounds shaft 92 and which is above and in frictional engagement with metering disc 96. Plate 108 includes a 90° pie shaped wedge 112. Wedge 112 has an outer perimetric edge 114 which is spaced radially inwardly from the cylindrical side wall 86. The diameter of edge 114 is such that edge 114 is positioned radially outwardly beyond the second circular array 100 of metering holes, and is positioned radially inwardly from the first circular array 98 of metering holes in disc 96.

Extending upwardly from plate 108 is a lug or pin 116 which protrudes upwardly within feed opening 88 so that it will strike the two lateral margins 118, 120 of feed opening 88. When shaft 92 and metering disc 96 rotate in a counterclockwise direction such as illustrated in FIG. 11, the frictional engagement between plate 108 and disc 96 causes the disc to be carried in a counterclockwise direction also until pin 116 strikes margin 120 of feed opening 88. This leaves feed opening 88 substantially open so that granulated material can fall freely through feed opening 88 and fill the pockets provided by holes 98, 100 in metering disc 96.

In order to reduce the volume of granulated material which is being metered, one can reverse the direction of shaft 92 so that it rotates in a clockwise direction such as shown in FIG. 12.

In this situation, the frictional engagement between plate 108 and disc 96 causes the plate 108 to be carried in a clockwise direction until pin 116 engages margin 118 of feed opening 88. In this position, plate 108 is in covering relation over holes 100, and leaves holes 98 exposed. Thus, as granulated material falls through feed opening 88, it is permitted to enter only holes 98, thereby reducing the amount of granulated material which is metered.

Thus, it can be seen that the device shown in FIGS. 10–12 provides two modes of operation. One mode is shown in FIG. 11 with the device operating in a counterclockwise direction and the other mode is shown in FIG. 12 with the device operating in a clockwise direction. Within each mode it is possible to adjust the amount of material metered by increasing or decreasing the velocity at which shaft 92 rotates.

When the granulated material falls through feed opening 88 into the cavities provided by holes 98, 100 in disc 96, it is carried by the disc 96 in a circumferential direction until the granulated material falls downwardly through outlet opening 90. This metering device has been found particularly advantageous for the metering of pigments which are added to the concrete, since these pigments are added in very small quantities in proportion to the aggregate and cement which is in the mixture.

Figure 7:
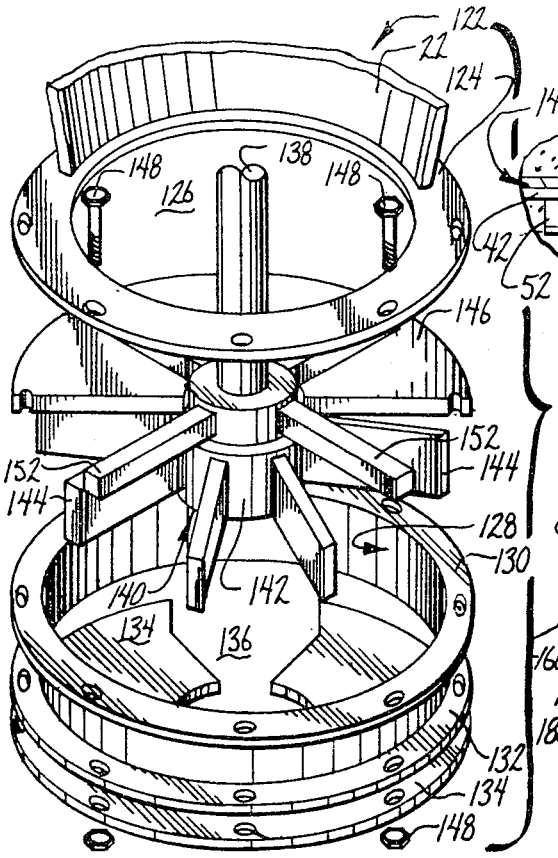
FIG. 7 is a perspective exploded view of the metering device of the present invention.
Figure 4:
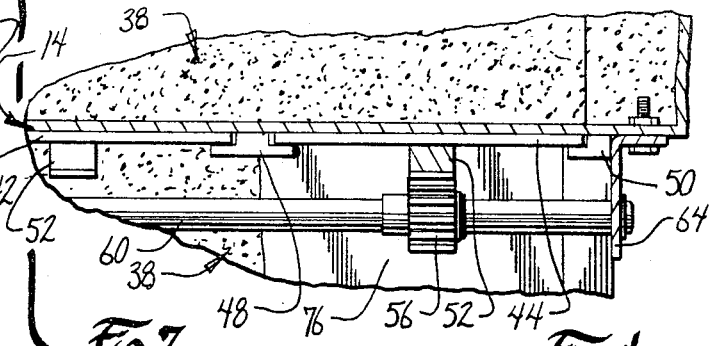
FIG. 4 is a sectional view taken along line 4—4 of FIG. 3.
Figure 8:
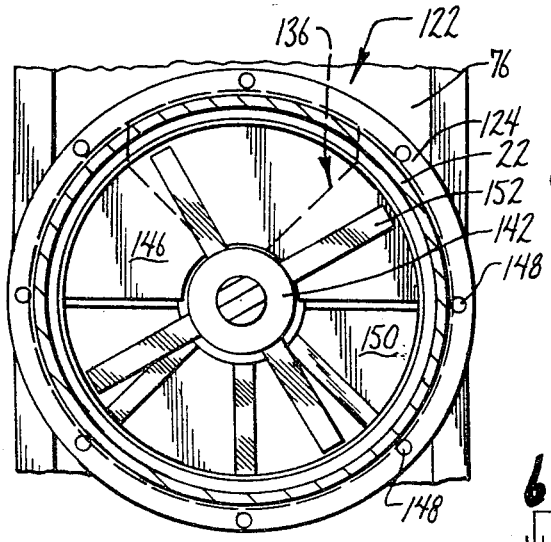
FIG. 8 is a top plan view of the metering device of FIG. 7 with certain portions broken away.
Figure 9:
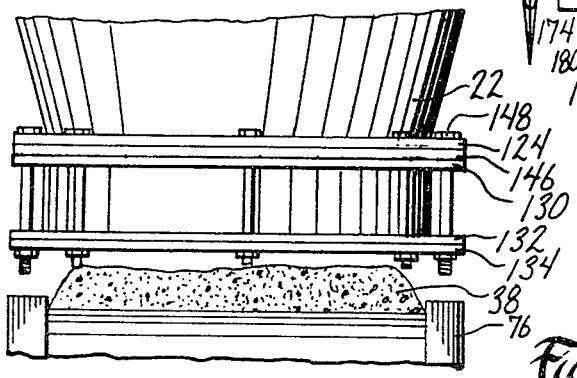
FIG. 9 is a front elevational view of the device shown in FIGS. 7 and 8.

Within cement hopper assembly 22 is a cement metering device 122 which is adapted to meter the desired quantity of cement to be added to the mixture on conveyor belt 76. Cement metering device 122 is shown in FIGS. 7–9.

Cement metering device 10 includes an upper wall formed by a circular ring 124 having an inlet opening 126 therein. Ring 124 is attached to a cylindrically shaped side wall 128 having an annular upper flange 130 and an annular lower flange 132. Ring 124 is bolted to upper flange 130 and a bottom wall 134 is bolted to lower flange 132. Bottom wall 134 includes an outlet opening 136 which comprises only a small portion of the circumference of bottom wall 134. The particular size of outlet opening 136 may be varied, but it is preferred that it be 180° or less.

Extending through the cylindrical center of cement metering device 122 is a drive shaft 138 which is drivingly connected to power means (not shown) which are capable of rotating shaft 138 at variable selective rates of speed. Preferably shaft 138 is coupled to the conveyor drive system so that the speed of the conveyor and of shaft 138 can be synchronized at the desired relative speeds.

Fixed to shaft 138 is a vaned metering wheel 140 having a hub 142 and a plurality of vanes 144 extending radially outwardly therefrom. Immediately above wheel 140 is a semi-circular cover plate 146 which is held by bolts 148 in fixed relation to ring 124 and side wall 128. Cover plate 146 is positioned so that it is in covering relation over outlet opening 136 and so that it provides a semi-circular feed opening 150 which is circumferentially offset from outlet opening 136.

Fixed to shaft 138 immediately above cover plate 146 is an agitator bar 152 having a plurality of spokes extending radially outwardly therefrom. Bar 152 agitates the granulated material so that it will fall freely through the feed opening 150. As it falls through opening 150, it is caught by vanes 144 and carried circumferentially within device 122 until it is positioned over outlet opening 136, at which time it falls downwardly out of outlet opening 136. The volume of cement metered can be adjusted by adjusting the rotational speed of shaft 138, increasing it relative to the velocity of the conveyor to increase the volume of cement metered and decreasing the velocity relative to the velocity of the conveyor to decrease the volume of cement metered. This change in relative speeds between the shaft 138 and the conveyor can be accomplished by adjusting the sprocket ratio between the metering device and the conveyor.

Thus, as conveyor belt 76 moves beneath hoppers 14, 16, 18, 20 and 22, it receives the various ingredients for the cement mixer. At the discharge end of conveyor assembly 26, all the ingredients have been deposited on the conveyor belt. At this point, they are deposited from the end of conveyor assembly 26 into the concrete mixer auger 24, and at the same time water is added to the mixture.

Figure 6:
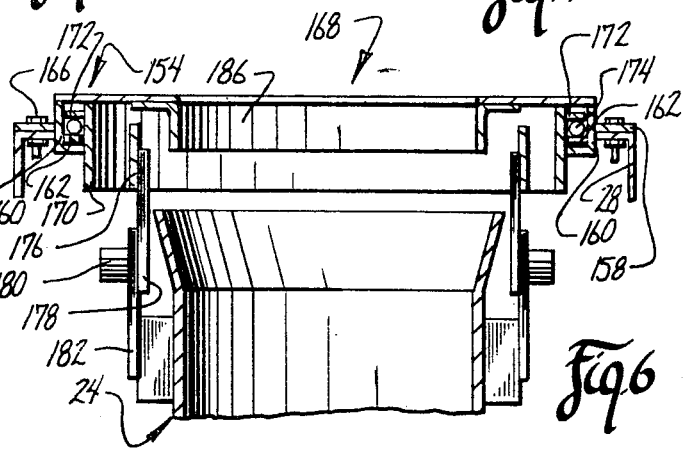
FIG. 6 is a sectional view taken along line 6—6 of FIG. 5.
Figure 5:
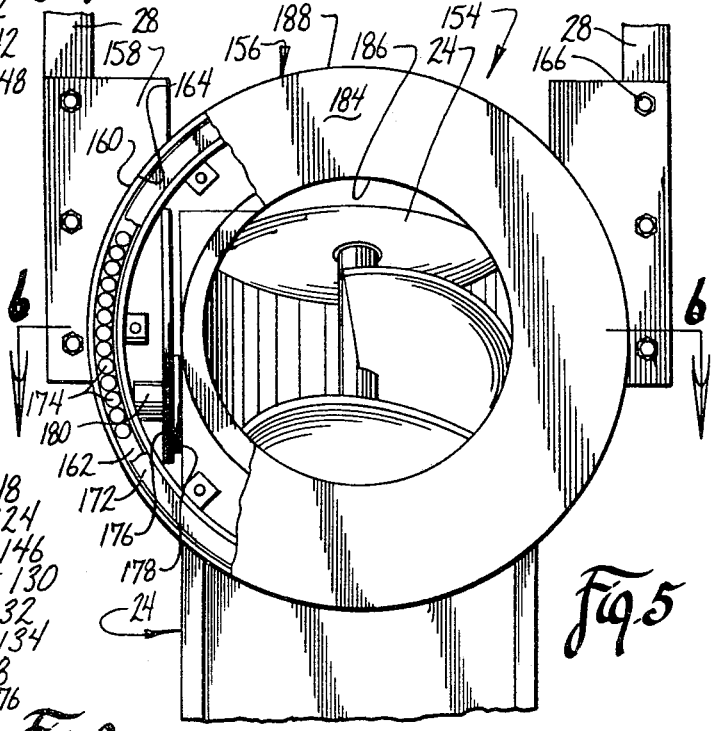
FIG. 5 is a sectional view taken along line 5—5 of FIG. 1.

A mounting assembly 154 is provided for mixer auger 24 and is shown in FIGS. 5 and 6. Mounting assembly 154 comprises a stationary outer ring 156 which is fixed to frame 28 by means of a pair of spaced apart mounting plates 158. Outer ring 156 in cross-section includes a vertically disposed band 160. Protruding radially inwardly from band 160 is an inwardly presented annular flange 162 which extends around the circumference of band 160. Mounting plates 158 include an arcuate edge 164 which is fitted to the outer surface of band 160 and which is welded thereto. A plurality of bolts 166 secure support plate 158 to a pair of spaced apart angles 170 on frame 28. Thus, stationary outer ring 156 is fixed to frame 28 and is held against movement with respect thereto.

A turret assembly 168 is mounted within stationary outer ring 156 for rotation with respect thereto. Turret assembly 168 comprises an inner ring or band 170 which is slightly smaller than outer band 160 and which includes an outwardly projecting annular flange 172. The width of flange 172 is approximately equal to the width of flange 162 and the two flanges 162, 172 are registered in vertical spaced alignment with respect to one another. Positioned between flanges 162, 172 is a circular arrangement of ball bearings 174 which permit inner ring or band 170 to rotate with respect to outer ring 160.

Welded to the interior surface of inner ring 170 are a pair of chord hanger plates 176. These hanger plates 176 support downwardly extending legs 178 which have outwardly protruding pivot lugs 180 thereon. The auger housing 182 is pivotally attached to lugs 180 for pivotal movement about a horizontal axis.

Attached to the upper edge of inner ring 170 is a cover plate 184 which is washer shaped and which includes an inner circumferential edge 186 defining a feed opening, and an outer circumferential edge 188 which extends radially outwardly in covering relation over stationary ring or band 160. This protects the bearings 174 and flanges 162, 172 from cement which falls downwardly out of hopper 22.

In operation, auger assembly 24 can be lifted about a horizontal axis provided by lugs 180. It can also be rotated about a vertical axis by virtue of the roller bearings 174 between flanges 162, 172. A winch 190 (FIG. 1) and cable 192 are provided for lifting auger assembly 24 about the horizontal axis provided by lugs 180. The ball bearings 174 permit the device to be manually rotated about a vertical axis with a minimum of effort, as is illustrated by the arrow 194 in FIG. 2.

The present invention provides many advantages over prior art devices for metering and mixing concrete. All of the ingredients in the present assembly are metered by volume rather than by weight. Furthermore, the metering is accomplished on a continuous basis, with each of the hoppers depositing a predetermined volume of ingredient on the conveyor 26 as it passes beneath the hoppers. The pigments are metered by the device shown in FIGS. 10–12, and variations in the quantity metered can be accomplished by increasing or decreasing the rotational speed of the device, or by reversing the speed of the device.

Similarly, the cement is metered by the device shown in FIGS. 7–9 which provides a continuous feed of cement to the conveyor belt. Variation in the quantity metered can be accomplished by increasing or decreasing the rotational speed of the vane wheel.

It has been found that cement may be mixed at a much faster rate by using this continuous volumetric metering approach, rather than by using the weight metering approach, commonly used in the prior art.

Thus, it can be seen that the device accomplishes at least all of its stated objectives.

What is claimed is:

1. An auger support assembly comprising:

a support structure, an outer circular collar having a vertical circular surface presented radially inwardly, a first annular horizontal flange affixed to said inwardly presented vertical circular surface and protruding radially inwardly therefrom;

an inner circular frame having a vertical circular surface presented radially outwardly towards said inwardly presented vertical circular surface of said outer collar;

a second annular horizontal flange affixed to said outwardly presented surface and protruding outwardly therefrom;

said first and second annular flanges being in vertical alignment with one another, a plurality of ball bearings positioned between said first and second annular flanges and being in rolling engagement with said first and second annular flanges whereby said outer collar and said inner collar may rotate about a vertical axis with respect to one another by virtue of the bearing engagement between said first and second flanges and said ball bearings, said outer collar being fixed to said support structure;

auger means connected to said inner collar.

2. An assembly according to claim 1 wherein a horizontal cover plate is attached to said inner collar, said cover plate being washer shaped with a flat circular horizontal surface having a circular inner margin and a circular outer margin, said circular inner margin defining a feed opening for receiving a plurality of ingredients for concrete.

3. An assembly according to claim 2 wherein said flat circular horizontal surface is positioned in covering relation over said inner and outer collars and said first and second flanges.

4. An assembly according to claim 3 wherein hinge means are operatively connected to said auger means and said inner collar for permitting said auger means to pivot about a horizontal axis with respect to said inner collar.

5. An improvement in a concrete mixing assembly comprising a conveyor having a first end and a discharge end, a flat gravel hopper positioned above said conveyor, a plurality of additional ingredient hoppers positioned above said conveyor for depositing pulverulent ingredients on said conveyor as said conveyor passes therebelow, auger mixing means having a feed opening positioned adjacent said discharge end of said conveyor, and a support frame connected to and supporting said hoppers and conveyors, auger mounting means connected to said auger means and said support frame, said improvement comprising:

said auger mounting means comprising an outer collar fixed to said support frame and an inner collar attached to said auger means;

said inner collar having a radially outwardly presented annular bearing flange, said outer collar having a radially inwardly presented annular bearing flange in vertical spaced alignment with said outwardly presented flange;

a plurality of ball bearings positioned between said inwardly and outwardly presented flanges so as to permit said inner collar to rotate about a vertical axis with respect to said outer collar.

* * * * *